US006073597A

United States Patent [19]

Harata et al.

[11] Patent Number: 6,073,597

[45] Date of Patent: Jun. 13, 2000

[54] FUEL INJECTION APPARATUS

[75] Inventors: Akinori Harata; Nobuo Imatake; Kimitaka Saito, all of Nishio; Keiso Takeda, Mishima, all of Japan

[73] Assignees: Nippon Soken, Inc., Nishio; Toyota Jidosha Kabushiki Kaisha, Toyota, both of Japan

[21] Appl. No.: 09/168,861

[22] Filed: Oct. 9, 1998

[30] Foreign Application Priority Data

Oct. 24, 1997 [JP] Japan ..... 9-292475

[51] Int. Cl.[7] ..... F02M 37/18; F02M 59/42

[52] U.S. Cl. ..... 123/179.14; 123/179.17

[58] Field of Search ..... 123/179.11, 179.12, 123/179.14, 179.16, 179.17, 447

[56] References Cited

U.S. PATENT DOCUMENTS 4,803,963 2/1989 Kleinhans ..... 123/179.12
5,664,532 9/1997 August ..... 123/179.11

FOREIGN PATENT DOCUMENTS 56-146051 11/1981 Japan .
5-321787 12/1993 Japan .

*Primary Examiner*—Andrew M. Dolinar
*Attorney, Agent, or Firm*—Pillsbury Madison & Sutro LLP

[57] ABSTRACT

A fuel injection apparatus which prevents delay of the pressurization of the fuel injected and deterioration of the starting characteristic at the time of engine cold starts and the resultant increase in emission of hydrocarbons by leading to an auxiliary startup pump the hydraulic pressure generated in the hydraulic cylinders supporting the driver's seat when the driver gets in the car and sits on the seat before startup, converts this to a high fuel pressure by large and small diameter cylinders, and obtains a fuel spray with a good atomization by a high fuel pressure immediately after startup. Other forces which can be used are the force generated in a hydraulic damper of a suspension by the weight of the driver when getting in the car, the force of opening the driver's side door, the force of stepping on the brake pedal, etc.

13 Claims, 3 Drawing Sheets

FUEL INJECTION APPARATUS

BACKGROUND OF THE INVENTION

1. Field of the Invention

The present invention relates to a fuel injection apparatus used for an internal combustion engine.

2. Description of the Related Art

A fuel injection apparatus using an ordinary fuel injector to feed fuel to an internal combustion engine (engine) pressurizes the fuel using a fuel pump in order to obtain the fuel injection pressure. A certain time is required in this case in order for the fuel to be injected to be pressurized to the prescribed pressure from when the driver turns the ignition switch on and the fuel pump starts operating at the time of startup of the engine.

Therefore, when the fuel injectors start injecting fuel in the state immediately after the start of the startup operation of the engine when the fuel has not yet been pressurized to the prescribed pressure, there is insufficient atomization of the injected fuel. Further, since the amount of injection is difficult to control in a state where the injection pressure has not reached the prescribed value, the problems of poor startup of the engine and an increased emission of hydrocarbons arise. Also, since the time required for pressurization of the fuel increases in proportion to the magnitude of the pressure in an engine injecting high pressure fuel, the above problems become even more serious.

When the engine is extremely cold, further, the voltage of the battery falls, so the performance of the battery-driven fuel pump falls as well. Also, the start motor, which is again driven by the battery, fails to turn strongly. Accordingly, the cranking speed becomes lower than during an ordinary temperature resulting in poor or failed startup in some cases.

Note that Japanese Unexamined Patent Publication (Kokai) No. 56-146051 discloses a fuel injection control apparatus designed to reduce the engine startup time by providing a switch attached to a door key, a door switch, a seat switch attached to the seat, or other "switch operated before startup" in parallel with the ignition switch, starting the driving of an electric fuel pump by the "switch operated before startup" before the driver turns the ignition switch on as the normal means of starting the engine, and thereby pressurizing the fuel to be injected in advance. In this case, however, the ordinary battery driven electric fuel pump is driven before the startup operation, so when the battery performance falls such as at extremely cold periods, there is again the problem of poor startup.

SUMMARY OF THE INVENTION

The present invention was made in consideration of the above problems of the related art and has as its object to provide a novel fuel injection apparatus which can improve the engine startup by a simple means.

Another object of the present invention is to provide a fuel injection apparatus which can avoid poor startup at extremely low temperatures.

Still another object of the present invention is to provide a fuel injection apparatus which can reduce the amount of hydrocarbons emitted at any engine startup time by improving the starting characteristic of the engine under such poor conditions.

The present invention provides a fuel injection apparatus described in the claims as a means for solving the above problems.

The present invention basically is characterized by pressurizing the fuel to be injected in advance by mechanically driving an auxiliary startup pump separate from the fuel pump using the force generated along with actions of the driver before startup of the engine.

The "actions of the driver" referred to here, means opening the driver's side door, sitting in the driver's side seat, stepping on the brake pedal, and other actions normally taken by a driver before starting up the engine. The "force generated along with actions of the driver", means the force of the arm of the driver when the driver opens the driver's side door increased by the door acting as a lever, the weight of the driver compressing the hydraulic cylinders supporting the driver's side seat when the driver sits on the driver's side seat, the weight of the driver compressing the hydraulic dampers used for the chassis suspension when the driver gets in the car, the force of the foot of the driver stepping on the brake pedal for engaging the brake, and other such forces.

Further, the force generated along with actions of the driver before engine startup is converted to hydraulic pressure or pneumatic pressure by a drive pressure generator or is increased as mechanical force by a lever or gear mechanism etc., then supplied to drive the auxiliary startup pump to pressurize the fuel to be injected without regard as to the fuel pump.

The fuel pre-pressurizing system in the fuel injection apparatus of the present invention, being configured as described above, enables reliable pressurization of the fuel before engine startup by a relatively simple mechanism and sufficiently increases the injection pressure of the fuel by the auxiliary startup pump so as to enable production of a fuel spray with an excellent state of atomization from the very start and thereby enables a smooth startup of the engine. Further, since a mechanically driven auxiliary startup pump is used, there is no chance of failed startup even when the battery performance falls such as at extremely low temperatures. In addition, according to the present invention, it is possible to reduce the amount of hydrocarbons emitted at the time of startup.

BRIEF DESCRIPTION OF THE DRAWINGS

These and other objects of the present invention will become clearer from the following description of the preferred embodiments given with reference to the accompanying drawings, in which.

DESCRIPTION OF THE PREFERRED EMBODIMENTS

Figure 1:
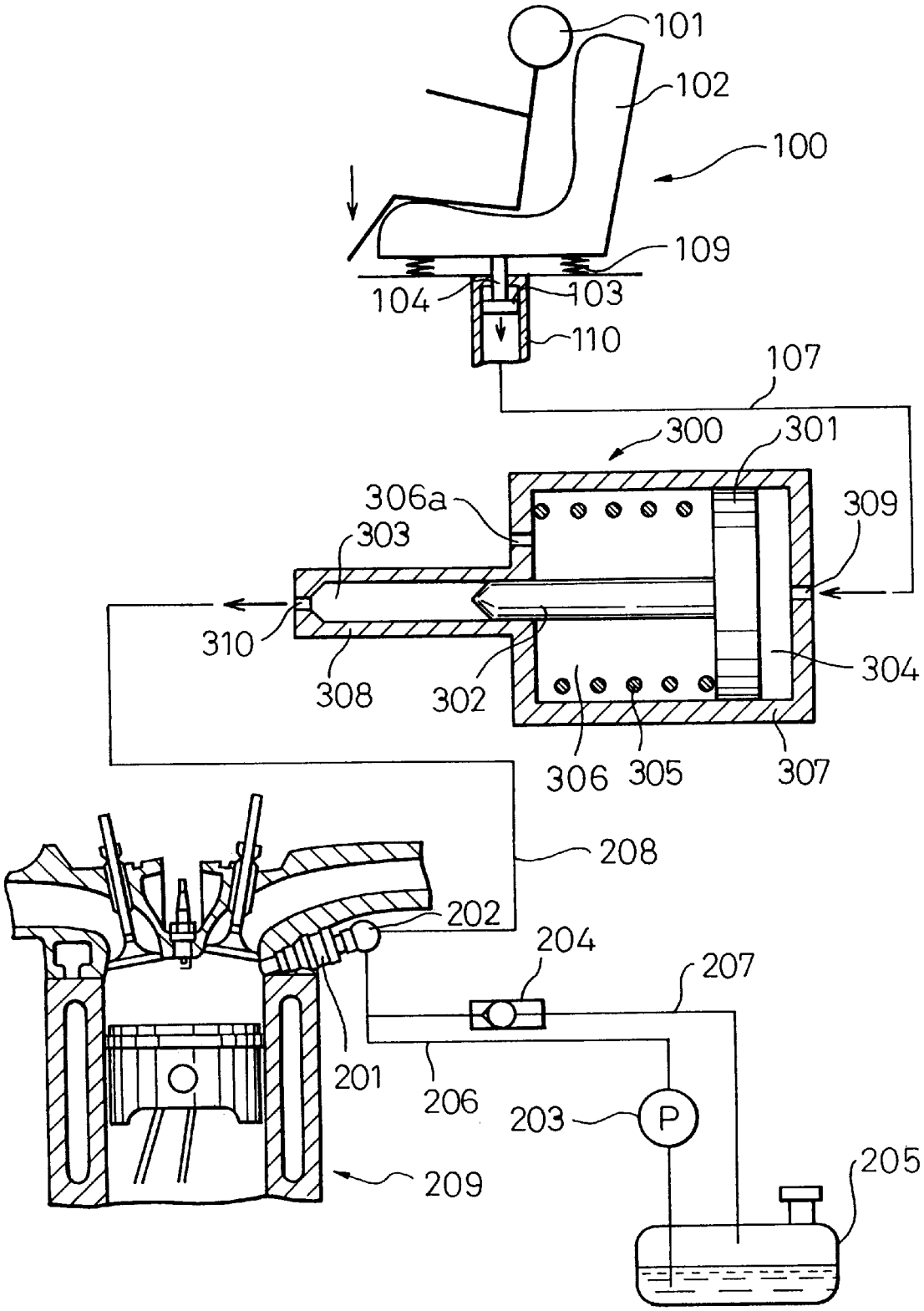
FIG. 1 is a view of the system configuration showing a first embodiment of the present invention.

A first embodiment of the present invention is shown in FIG. 1. In this embodiment, the auxiliary startup pump 300 constituting the fuel pre-pressurizing system characterizing the fuel injection apparatus of the present invention is comprised of a large diameter piston 301, a small diameter piston 302 coaxial and integral with the same, a large diameter cylinder 307, and a small diameter cylinder 308 coaxial and integral with the same. The pistons 301 and 302 are slidingly fit in the cylinders 307 and 308. The cylindrically shaped space 304 in the large diameter cylinder 307 is divided into two chambers 304 and 306 by the large diameter piston 301. An inlet port 309 is provided at the end of the chamber on the opposite side of the small diameter piston 302.

Reference numeral 310 is an outlet port which opens to the end of the small diameter cylinder 308 and which communicates the inside space 303 of the small diameter cylinder 308 with the fuel pipe 208. The pipe 208 is communicated with a delivery pipe 202. Reference numeral 305 is a compression spring which is provided in the large diameter cylinder 307 and which biases the integral large and small diameter pistons 301 and 302 toward the right in FIG. 1 at all times. Note that reference numeral 306*a* is a vent for communicating the chamber 306 with the atmosphere.

Reference numeral 100 is a drive pressure generator which generates pressure for operating the auxiliary startup pump 300. The driver's side seat 12 of the car is connected with the piston 103 and a piston rod 104 to be able to move linked with them in the vertical direction. The piston 103 is slidingly fit in the fixed cylinder 110. Further, the cylinder 110 is communicated with the inlet port 309 of the auxiliary startup pump by a hydraulic piping 107. A working oil is filled in the hydraulic piping 107 and under the piston 103 in the cylinder 110.

Reference numeral 203 is an ordinary pressurizing pump (fuel pump) for pressurizing the fuel supplied from a fuel tank 205 at the time of operation and is communicated with a delibery pipe 202 by a piping 206. Reference numeral 204 is a regulator for controlling the fuel injection pressure, while 201 is a fuel injector for injecting and supplying fuel into the internal combustion engine.

Since the fuel injection apparatus including the fuel pre-pressurizing system of the first embodiment has such a configuration, when the driver 101 sits on the seat 102 before starting the engine 209, the weight of the driver causes the seat 102 to compress the seat spring 109 together with the piston 103 connected with the same to move it downward and causes the working oil in the cylinder 110 to be pressurized. The working oil pressurized in this way is supplied through the piping 107 and the inlet port 309 of the auxiliary startup pump 300 to the right side chamber 304 in the large diameter cylinder 307. As a result, the large diameter piston 301 of the auxiliary startup pump 300 overcomes the biasing force of the spring 305 due to the oil pressure supplied to the chamber 304 and moves to the left in FIG. 1. Accordingly, the small diameter piston 302 integral with the large diameter piston 301 sends the fuel in the small diameter cylinder 308 to the delivery pipe 202 under pressure.

In this case, if the ratio of the area of the large diameter piston 301 and small diameter piston 302 is made 30:1, the pressure of the working oil generated due to the weight of the driver and acting in the chamber 304 is converted to about a 30 times higher fuel pressure by the drive pressure generator 100 and the oil is discharged from the outlet port 310, so it is possible to rapidly raise the pressure of the fuel supplied to the fuel injector 201 at the time of starting of the engine. Due to the above action, it becomes possible to secure the fuel pressure needed for a good start of the engine before the start of the engine 209.

Next, a second embodiment of the present invention shown in FIG. 2 will be explained. In this embodiment, an auxiliary startup pump 500, the main part of the fuel pre-pressurizing system, has a configuration similar to that of a conventional brake booster mechanism. That is, in the auxiliary startup pump 500, the space inside a cylinder 521 is divided into two chambers 504 and 505 by a large diameter piston 511 integral with a bellows 512. A right side chamber 504 accommodates a piston rod 513 integral with the large diameter piston 511 and a medium diameter piston 503 opening and closing a passage 522 formed at an end of a cylinder 521. These integral pistons 503 and 511 are connected with a small diameter piston 502 slidingly fit into a small diameter cylinder 107*c* communicating with a hydraulic piping 107*b*. A solenoid valve 409 is provided between the hydraulic piping 107*b* and the extension of the same, that is, the hydraulic piping 107*a*.

At the center of the left side chamber 505 in the cylinder 521 extends a piston rod 515 integral with the large diameter piston 511. The front end of the rod 515 is connected with a small diameter piston 514 slidingly fit inside a small diameter cylinder 208*a* communicated with fuel piping 208. Reference numeral 506 is a compression spring which is provided in the left side chamber 505 and which biases the large diameter piston 511 and medium diameter piston 503 to the right. Small diameter air holes 507 and 508 are provided in the left chamber 505 and right chamber 504 of the cylinder 521. These air holes and the air piping 509 communicate the left chamber and right chamber of the cylinder 521 through a solenoid valve 510 to an engine negative pressure source.

Reference numeral 400 is a drive pressure generator which generates pressure for operating the auxiliary startup pump 500. A piston 405 is connected by a coupling 404 to a front of a pivot shaft 402 of a door 401 on the driver side of the automobile. The piston 405 is slidingly fit inside a cylinder 410. The cylinder 410 is connected to a solenoid valve 409 through the hydraulic piping 107*a*.

Before the engine is started up, when the driver gets in the automobile, he or she first opens the driver's side door 401. The coupling 404 turns about the pivot shaft 402 and the force increased by the lever action powerfully pushes and moves the piston 405 connected with the door 401 to pressurize the working oil in the cylinder 410. The pressurized working oil passes through the piping 170*a* and 170*b* and moves the piston 502 of the auxiliary startup pump 500 to the right in FIG. 2. At this time, the inside of the cylinder 521 of the pump 500 is communicated with the negative pressure source by the opening of the solenoid valve 510 during engine operation, so that even when the engine 209 stops, the left chamber 505 and the right chamber 504 are held in a negative pressure state.

When the piston 502 moves to the left, the medium diameter piston 503 integral with it moves to the left. At this time, since the passage 522 normally closed by the medium diameter piston 503 is opened, the right chamber 504 and the outside of the cylinder 521 are communicated. The air passes through the passage 522 and flows into the right chamber 504 causing a pressure difference between the left chamber 505 and the right chamber 504.

The force caused by the action of this pressure difference on the large diameter piston 511 and the bellows 512 is transmitted to the small diameter piston 514 by the piston rod 515. The piston rod 514 moves to the left, whereby the fuel in the piping 208 is pressurized and the fuel injection pressure in the delivery pipe 202 rises. In this case, the [pressure receiving area of the bellows 512 and the piston 511]×[pressure difference between the left chamber 505 and right chamber 504] becomes the output of the auxiliary startup pump 500. Due to the above action, the fuel pressure can be sufficiently raised in pressure before the start of the engine 209, so a good start of the engine becomes possible.

Note that in this case, the driver normally closes the door before starting the engine. The operation of the door 401 is detected by a sensor 403 provided near the pivot shaft 402.

When the door is opened more than a predetermined angle, the connection between the piping 107*a* and 107*b* is broken by the solenoid valve 409. Even if the door is then closed, the pressure in the piping 107*b* can be maintained.

After the fuel injection at the time of startup is completed, a timer etc. opens the solenoid valve 409 to communicate the piping 107*a* and 107*b* and lower the pressure in the piping 107*b*, whereby the medium diameter piston 503 in the cylinder 521 is pushed by the spring 506 to the right and again closes the passage 522, so the connection between the right chamber 504 and the outside is broken. As explained above, by opening the solenoid valve 510 during operation of the engine 209, the right chamber 504 and left chamber 505 are both placed in a negative pressure state, but the solenoid valve 510 is closed while the engine is stopped so as to hold the chambers 504 and 505 at a negative pressure.

In this way, the fuel pre-pressurizing system of the second embodiment also enables the pressure of the fuel to be injected to be raised before the engine is started and a good fuel injection to be achieved from the very beginning in the same way as the first embodiment.

Figure 3:
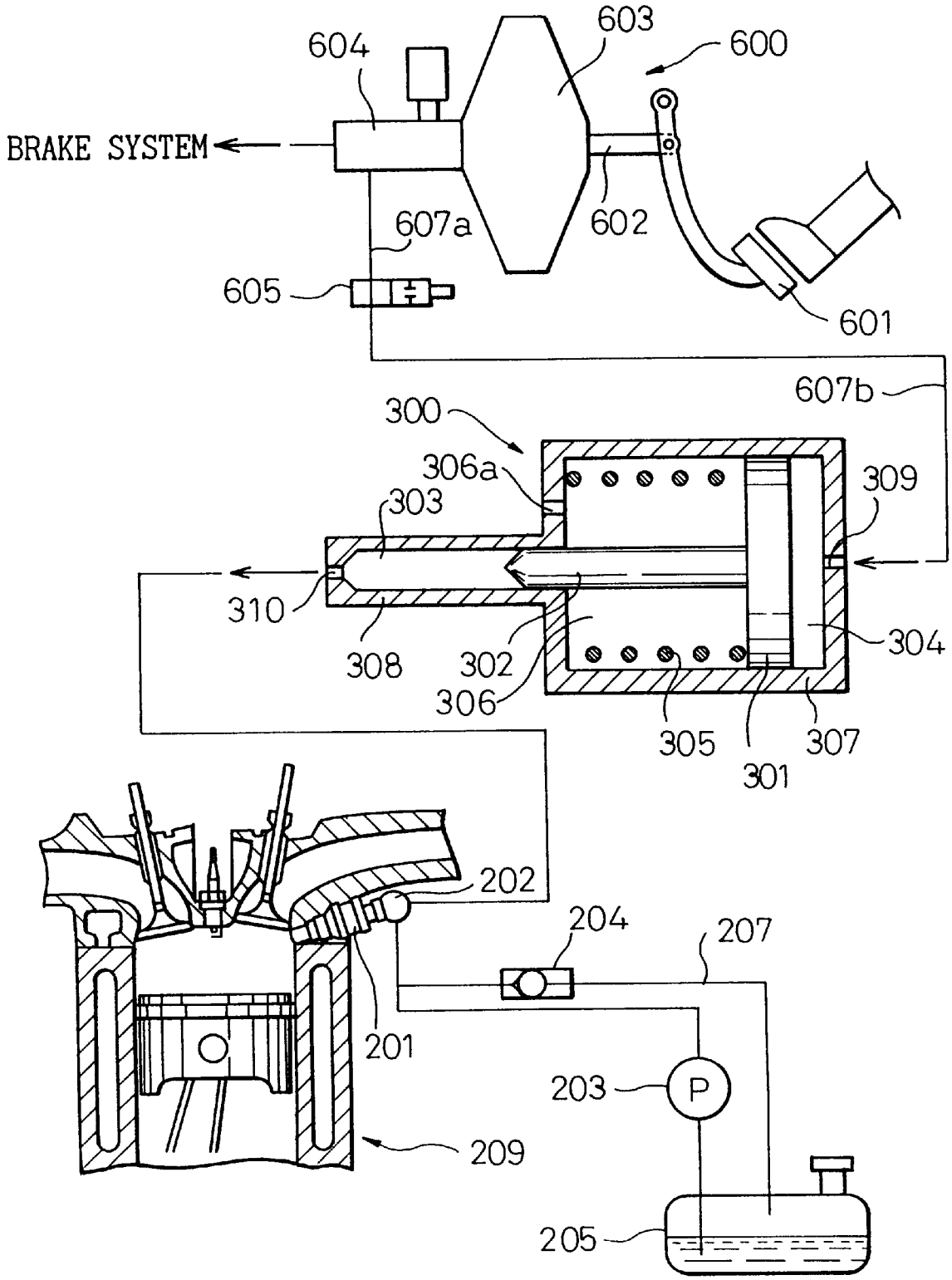
FIG. 3 is a view of the system configuration showing a third embodiment of the present invention.

Next, a third embodiment of the present invention will be explained using FIG. 3. Part of the configuration of the auxiliary startup pump 300 is the same as the first embodiment shown in FIG. 1. As the drive pressure generator 600 for operating the auxiliary startup pump 300, however, the existing brake system is used and the high hydraulic pressure generated by a master cylinder 604 is used to drive the auxiliary startup pump 300. Note that the brake system shown in FIG. 3 is provided with a brake pedal 601 operated by the driver's foot, a piston rod 602, a brake booster 603, etc. As clear from this configuration, brake fluid is filled in the piping 607*a* and 607*b* and the chamber 304.

By the driver stepping on the brake pedal 601 before engine startup, brake fluid pressure is generated in the master cylinder 604. At the same time, the solenoid valve 605, which is normally in the closed position, becomes open, whereby the piping 607*a* and 607*b* of the brake fluid are communicated. The brake fluid generated in the master cylinder 604 is applied to the right chamber 304 of the auxiliary startup pump 300, the large diameter piston 301 and the small diameter piston 302 move to the left in the figure, the fuel in the space 303 inside the small diameter cylinder 308 is pressurized, and the fuel injection pressure in the delivery pipe 202 is raised.

Note that in this case, the driver has to continue pressing down on the brake pedal in order to maintain the brake fluid pressure of the chamber 304 until the engine 209 is started. To avoid this, it is possible to close the solenoid valve 605 and break the connection between the piping 607*a* and 607*b* so as to maintain the pressure in the chamber 304 when a sensor, not shown, detects that a sufficient brake fluid pressure has been supplied to the chamber 304. Further, basically, after the engine 209 is started, the solenoid valve 605 is closed, so there is no chance of the brake system being affected in any way during engine operation.

As another embodiment, it is also possible to use as the pressure source (drive pressure generator) for operating the auxiliary startup pump 300 or 500 the automobile suspension, which is provided with hydraulic dampers which contract when the driver and passengers get in the automobile, take out the hydraulic pressure generated in the hydraulic dampers or to provide a hydraulic cylinder for converting the force for fastening the seatbelt into hydraulic pressure at the support portion of the end of the seatbelt, and use that hydraulic pressure.

Figure 2:
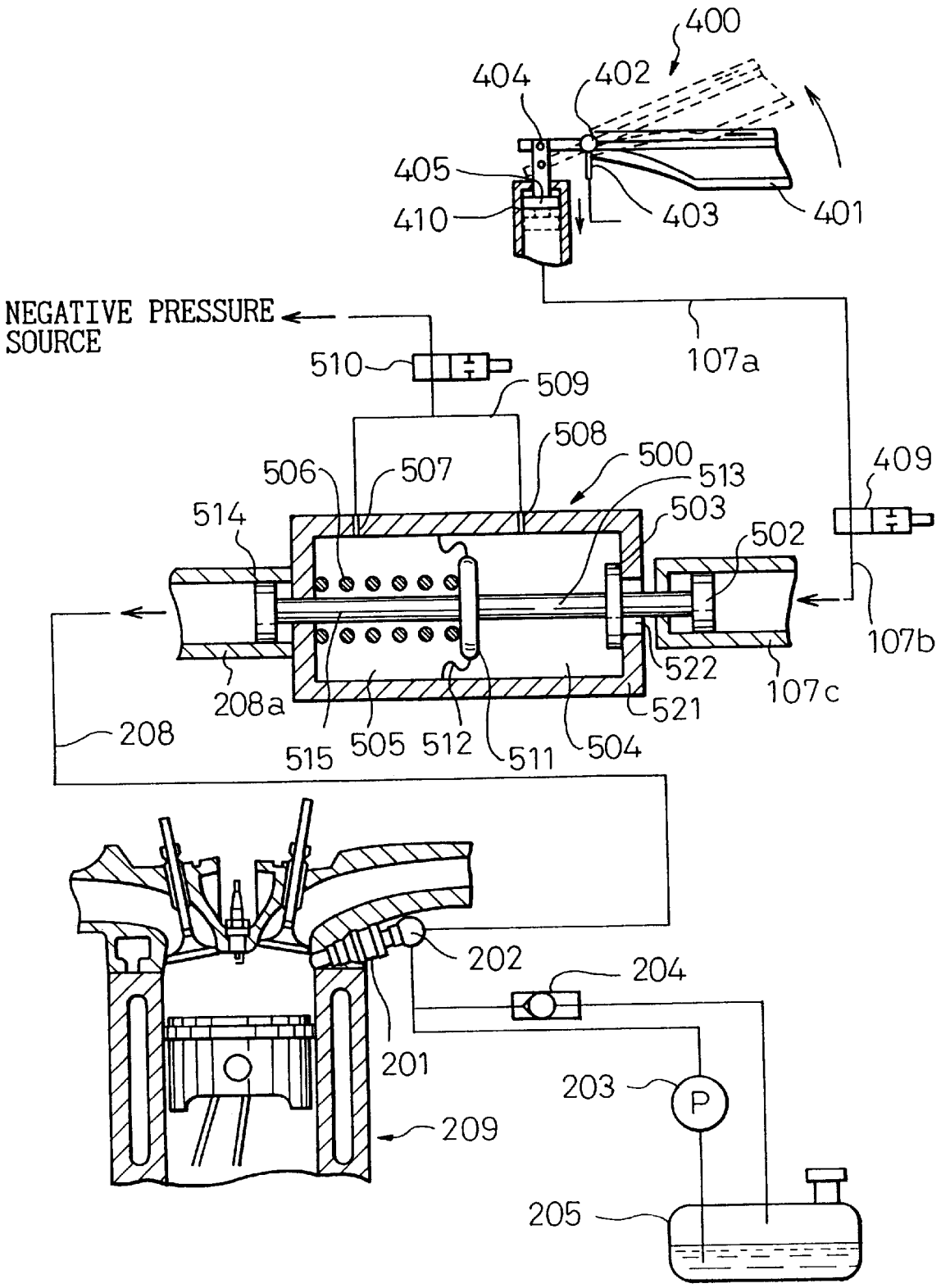
FIG. 2 is a view of the system configuration showing a second embodiment of the present invention.

Further, in the first embodiment shown in FIG. 1, while the drive pressure generator 100 for operating the auxiliary startup pump 300 was illustrated is one using the weight of the driver applied to the seat 102, it is also possible to operate this by the operating force of the door as in the second embodiment shown in FIG. 2. Further, the drive pressure generator 400 for operating the auxiliary startup pump 500 in the second embodiment, like the first embodiment and the third embodiment, may be designed to be operated by the seat pressure, braking pressure, suspension pressure, etc.

Needless to say, it is also possible to provide two or more drive pressure generators for operating the auxiliary startup pump 300 or 500. Further, it is possible not to use a hydraulic device or pneumatic device, but use an action of the driver before engine startup through a mechanism such as a lever or gear mechanism to drive the auxiliary startup pump purely mechanically.

While the invention has been described by reference to specific embodiments chosen for purposes of illustration, it should be apparent that numerous modifications could be made thereto by those skilled in the art without departing from the basic concept and scope of the invention.

What is claimed is:

1. A fuel injection apparatus for an internal combustion engine of an automobile, comprising:

a fuel injector for injecting fuel into the engine for combustion;

a primary fuel pump for pressurizing fuel from a fuel source supplied to the fuel injector;

a mechanical auxiliary startup pump separate from the primary fuel pump for pressurizing the fuel supplied to the fuel injector prior to pressurization by the primary fuel pump, the mechanical auxiliary startup pump actuated by at least one of the following:

an actuator operatively connected between a driver's side door of the automobile and the startup pump and adapted to actuate the startup pump by an opening of the driver's side door;

an actuator operatively connected between a driver's side seat of the automobile and the startup pump and adapted to actuate the startup pump by a sitting of the driver upon the seat; and an actuator operatively connected between a brake pedal of the automobile and the startup pump and adapted to actuate the startup pump by a pressing of the brake pedal by the driver.

2. A fuel injection apparatus as in claim 1, wherein at least one of the actuators comprises:

a hydraulic cylinder adapted to supply pressurized hydraulic fluid to actuate the startup pump.

3. A fuel injection apparatus as in claim 2, and further comprising:

a pneumatic cylinder connected between the hydraulic cylinder and the startup pump, the pneumatic cylinder adapted to be actuated by the pressurized hydraulic fluid to actuate the startup pump.

4. A fuel injection apparatus as in claim 1, wherein at least one of the actuators comprises:

a pneumatic cylinder adapted to actuate the startup pump.

5. A fuel injection apparatus as in claim 1, wherein at least one of the actuators further comprises:

a mechanical force multiplier adapted to multiply a mechanical force applied to the actuator to increase an actuating force applied by the actuator to the startup pump.

6. A method for a driver to supply pressurized fuel from a fuel source to a fuel injector for an internal combustion engine of an automobile prior to supplying pressurized fuel from a primary fuel pump to the fuel injector, the method comprising the steps of:

applying a force to actuate a mechanical auxiliary startup pump separate from the primary fuel pump prior to starting the engine, the force being applied by at least one of the following steps:

opening a driver's side door;

sitting in a driver's side seat; and stepping on a brake pedal.

7. A method as in claim 6, and further comprising the step of:

actuating a hydraulic cylinder connected to the driver's side door to supply hydraulic fluid to actuate the startup pump by opening the driver's side door.

8. A method as in claim 7, and further comprising the step of:

actuating a pneumatic cylinder connected between the hydraulic cylinder and the startup pump with the hydraulic fluid to actuate the startup pump.

9. A method as in claim 6, and further comprising the step of:

actuating a hydraulic cylinder connected to the driver's side seat to supply hydraulic fluid to actuate the startup pump by sitting in the driver's side seat.

10. A method as in claim 9, and further comprising the step of:

actuating a pneumatic cylinder connected between the hydraulic cylinder and the startup pump with the hydraulic fluid to actuate the startup pump.

11. A method as in claim 6, and further comprising the step of:

actuating a master cylinder connected to the brake pedal to supply hydraulic fluid to actuate the startup pump by stepping on the brake pedal.

12. A method as in claim 11, and further comprising the step of:

actuating a pneumatic cylinder connected between the master cylinder and the startup pump with the hydraulic fluid to actuate the startup pump.

13. A method as in claim 6, and further comprising the step of:

mechanically multiplying the applied force to increase an actuating force applied to the startup pump.

* * * * *